US005152933A

United States Patent [19]

Holland

[11] Patent Number: 5,152,933

[45] Date of Patent: Oct. 6, 1992

[54] ETHYLENE OXIDE/PROPYLENE OXIDE COPOLYMERS AS CO-SURFACTANTS WITH DETERGENCY BOOSTING PROPERTIES IN COMPOSITIONS ALSO CONTAINING ALKYL BENZENE SULFONATE AND ETHOXYLATED ALCOHOL

[75] Inventor: Richard J. Holland, Grosse Ile, Mich.

[73] Assignee: BASF Corporation, Parsippany, N.J.

[21] Appl. No.: 569,790

[22] Filed: Aug. 20, 1990

[51] Int. Cl.[5] ..... C11D 1/22; C11D 1/831

[52] U.S. Cl. ..... 252/559; 252/174.21; 252/174.22; 252/556; 252/558; 252/DIG. 1; 252/DIG. 14

[58] Field of Search ..... 252/174.21, 174.22, 252/556, 558, 559, DIG. 1, DIG. 14

[56] References Cited

U.S. PATENT DOCUMENTS

| | | | |
|---|---|---|---|
| 3,625,909 | 12/1971 | Berg | 252/174.22 |
| 3,869,399 | 3/1975 | Collins | 252/548 |
| 3,882,038 | 5/1975 | Clayton et al. | 252/174.22 |
| 3,886,098 | 5/1975 | DiSalvo et al. | 252/540 |
| 4,196,103 | 4/1980 | Richter | 252/541 |
| 4,280,919 | 7/1981 | Stoeckigt et al. | 252/99 |
| 4,306,987 | 12/1981 | Kaneko | 252/174.22 |
| 4,316,824 | 2/1982 | Pancheri | 252/174.22 |
| 4,379,069 | 4/1983 | Rapisarda et al. | 252/174.21 |
| 4,397,777 | 8/1983 | Yurko | 252/153 |
| 4,410,447 | 10/1983 | Decker et al. | 252/174.22 |
| 4,414,128 | 11/1983 | Goffinet | 252/546 |
| 4,482,477 | 11/1984 | Allen et al. | 252/540 |
| 4,780,237 | 10/1988 | Schmid et al. | 252/174.22 |
| 4,857,213 | 8/1989 | Caswell et al. | 252/547 |

OTHER PUBLICATIONS

McCatcheon', *Emulsifiers and Detergents* North American Edition, 1983, p. 203.

*Primary Examiner*—Paul Lieberman
*Assistant Examiner*—Bradley A. Swope

[57] ABSTRACT

Low levels (2–6 percent active) of ethylene oxide/propylene oxide block copolymers have been found to significantly enhance the oily and particular soil removal of detergents containing anionic surfactants and ethoxylated alcohols or other oxyalkylate surfactants.

11 Claims, No Drawings

ETHYLENE OXIDE/PROPYLENE OXIDE COPOLYMERS AS CO-SURFACTANTS WITH DETERGENCY BOOSTING PROPERTIES IN COMPOSITIONS ALSO CONTAINING ALKYL BENZENE SULFONATE AND ETHOXYLATED ALCOHOL

BACKGROUND OF THE INVENTION

1. Field of Invention

This invention relates to certain nonionic surfactants which when used as co-surfactants in detergent formulations provide improvement in both oily and particulate soil removal. More specifically block copolymers of ethylene oxide and propylene oxide are used in formulations with mixed actives or other oxyalkylated nonionic surfactants. These detergent formulations provide performance improvements beyond those obtained using systems without the subject block copolymers, or those in which the block copolymers are used as the sole surfactant.

2. Description of the Related Art

The use of EO/PO copolymers in detergent formulations has been disclosed. Such uses include those formulations where the copolymers prove to be effective anti-redeposition agents or provide low foaming characteristics to the formulation.

The following patents disclose the use of EO/PO block copolymers as anti-redeposition agents; US 4,724,095, JP 62/4797, PL 130944, and JP 59/6269. U.S. Pat. No. 4,724,095, assigned to Rhone-Poulenc discloses the use of PLURONIC ® polyols as anti-redeposition agents in phosphate built powdered detergents. JP Pat. No. 62/4797, assigned to Kao Soap Company discloses an anionic detergent containing 0.5% PLURONIC ® L-64 as an anti-redeposition agent. PL (Polish) Pat. No. 130944, discloses a polyethylene oxide/polypropylene oxide/polyethylene oxide triblock polymer added to a detergent formulation as an anti-redeposition agent. JP Pat. No. 59/6299, discloses an additive mixture for a detergent/softener composition including a quaternized nitrogen compound, polyethylene glycol, an EO/PO copolymer and polyvinyl alcohol or polyvinyl pyrrollidone, wherein said composition promotes softening and inhibits anti-redeposition. None of the above references disclose or claim compositions with EO/PO copolymers as co-surfactants which improve detergency characteristics.

U.S. Pat. No. 3,101,374, discloses the use of conjugated polyoxyalkylene compounds having a heteric structure as having some carbon soil removal performance. There is no showing of improved detergency performance when these compounds are combined in detergent formulations containing anionic surfactants or other nonionic surfactants.

U.S. Pat. No. 2,677,700 and an article in the *Journal of the American Oil Chemical Society,* Volume 28, 294 (1951) disclose the use of PLURONIC polyols which exhibit both carbon soil removal and anti-redeposition properties. Neither reference suggests the possibility of enhanced detergency performance when the subject compounds are used in conjunction with other nonionic or anionic surfactants.

Other uses for EO/PO block copolymers disclosed in the literature include, foam reduction (JP 60/235900) and improvement of flow properties in a powder detergent formulation (FR 2617183).

SUMMARY OF THE INVENTION

It has been discovered that certain nonionic surfactants, specifically block copolymers of ethylene oxide and propylene oxide, improve both oily and particulate soil removal when used as co-surfactants in formulations containing mixed actives. Improvements in particulate soil removal are also observed in formulations that contain only nonionic surfactants. In either case the improvements noted are beyond those obtained by adding additional amounts of the primary surfactant or using the block copolymers as the only surfactant. The block copolymers of the instant invention can be incorporated into heavy duty liquid detergents (HDL's) or built powder detergents.

DETAILED DESCRIPTION OF THE INVENTION

Surprisingly, it has been discovered that certain nonionic surfactants used at low levels (2–6 weight percent active) as co-surfactants in formulations containing mixed actives significantly enhance both oily and particulate soil removal. Improvements in particulate soil removal are observed in formulations containing only nonionic surfactants. The nonionic co-surfactants of the present invention are block copolymers derived from the oxyalkylation of an initiator having more than one reactive hydrogen.

Because of legislative restrictions against the use of phosphorous compounds in detergents the need to find effective detergency boosters, as replacements for these phosphorous compounds, has become more important. The compounds of the present invention meet this need by providing an effective detergency booster that may be used in detersive systems having mixed actives, e.g. anionic surfactants and oxyalkylated nonionic surfactants, or in systems where the sole active detergent is a nonionic surfactant. The nonionic block copolymers of the present invention are especially important in liquid detergent formulations (HDL's) where it is difficult to incorporate builders and form clear, single phase formulations. The compounds of the present invention provide performance enhancements at low additive levels (2–6 percent active).

It is understood that additives commonly used in detergent formulations e.g., hydrotropes, buffers, builders anti-redeposition agents, and other additives may be used in conjunction with the nonionic block copolymers and are therefore within the scope and spirit of this invention. It should be further noted that the block copolymers of the present invention may be incorporated into built powder detergents and that the performance enhancements are equally evident in both liquid and powder systems.

Nonionic Block Copolymer Co-Surfactant

The block copolymers which act as co-surfactants in the present invention are known by those skilled in the art and are represented by the following general formula:

$$Y[(C_3H_6O)_n—E—H]_x$$

where

Y is the residue of an organic compound containing therein x active hydrogen atoms, n is an integer, x is an integer greater than 1, and E is a polyoxyethylene chain.

One such example are those compounds marketed by BASF Corporation under the trademark PLURONIC.

The nonionic block copolymers of the present invention are prepared by first condensing propylene oxide with an organic compound containing a plurality of reactive hydrogens to prepare a polyoxypropylene polymer, and subsequently condensing ethylene oxide therewith. A complete description of the preparation of these compounds is set forth in U.S. Pat. No. 2,674,619 and is hereby incorporated, in its entirety, by reference. According to the present invention a preferred block copolymer contains 30 to 50 percent ethylene oxide. The molecular weight of the propylene oxide hydrophobe ranges from about 950 to about 4000. A more preferred block copolymer contains 40 percent ethylene oxide and a propylene oxide block having a molecular weight of 1750 as determined by hydroxyl number.

Other Nonionic Surfactants

Other nonionic oxyalkylated surfactants with which PLURONIC block copolymers of the present invention may be combined, as the co-surfactant are well known in the art. These include the reaction product of a hydrophobe having a single reactive hydrogen and one or more oxyalkylene oxides; the former is aliphatic or alkylaromatic in nature. The length of the hydrophilic polyoxyalkylene radical which is condensed with any particular hydrophobic group can be readily adjusted to yield a water soluble compound having the desired balance between hydrophilic and hydrophobic elements.

Illustrative but not limiting examples of the various chemical types of suitable nonionic compounds include:

a) polyoxyalkylene condensates of aliphatic monocarboxylic acids, b) polyoxyalkylene condensates of alkyl phenols, and c) polyoxyalkylene condensates of aliphatic alcohols.

The preferred compound being those polyoxyalkylene condensates of aliphatic alcohols having from 8 to 25 carbon atoms, whether branched or linear. Examples include the ethoxylated alcohols marketed by Shell under the NEODOL trademark or the oxyalkylated alcohols marketed by BASF Corporation under the PLURAFAC trademark.

Anionic Surfactants

A wide variety of anionic surfactants may be utilized. Anionic surfactants can be broadly described as surface active compounds with negatively charged functional groups(s). An important class within this category are the water-soluble salts, particularly alkali metal salts, of organic sulfur reaction products. In their molecular structure is an alkyl radical containing from about 8 to 22 carbon atoms and a radical selected from the group consisting of sulfonic and sulfuric acid ester radicals. Such surfactants are well known in the detergent art. They are described at length in "Surface Active Agents and Detergents", Vol. II, by Schwartz, Perry & Berch, Interscience Publishers Inc., 1958 herein incorporated by reference.

Particularly suitable anionic surfactants for the instant invention are the higher alkyl mononuclear aromatic sulfonates. They contain from 10 to 16 carbon atoms in the alkyl chain. Alkali metal or ammonium salts of these sulfonates are suitable, although the sodium salts are preferred. Specific examples include: sodium linear tridecyl benzene sulfonate; and sodium p-n-dodecyl benzene sulfonate.

Other Additives

The presence of a hydrotrope within the composition is highly desirable. Hydrotropes are substances that increase the solubility in water of another material which is only partially soluble. Preferred hydrotropes are the alkali metal or ammonium salts of benzene sulfonic acid, toluene sulfonic acid and xylene sulfonic acid.

Those skilled in the art understand that any builder suitable for use in a liquid detergent composition may be used in the present invention. Examples of organic builder salts which can be used alone or in admixture with each other or with inorganic alkaline builder salts are alkali metal polycarboxylates, sodium and potassium citrate, sodium and potassium tartarate, sodium and potassium N-(2-hydroxyethyl)-ethylenediamine tetracetates, sodium and potassium nitrilotriacetates, and sodium and potassium N-(2-hydroxyethyl)-nitrilodiacetates. These builders may be used separately or as mixtures.

It does not deviate from the spirit of the invention to include minor amounts of inorganic builders either alone or in combination with the above mentioned organic builders. Examples of these include alkali metal carbonates, phosphates, polyphosphates, zeolites and silicates.

The following examples are presented to illustrate various aspects of the invention. Those skilled in the art understand that they are not to be construed as limiting the scope or spirit of the invention.

EXAMPLES

The soil removal performance of three formulations was evaluated using a mixed soil load. For the particulate soil, ground in clay swatches (supplied by Scientific Services, Oakland, N.J.) were used including three fabric types: cotton (S-405), polyester (S-767) and D(65)/C(35) blend (S-7435). The oily soil consisted of Spangler sebum/air conditioner dust and was also applied to cotton, polyester and blend fabrics (Scientific Services). The type and number of soiled swatches used are shown along with the results of each evaluation. Terg-o-Tometer evaluations were carried out with each formulation. In some cases washing machine studies were also conducted.

Wash conditions were 100° F. and 150 ppm water hardness (2:1 $CA^{++}/Mg^{++}$ ratio). A ten minute wash and five minute rinse cycle (with hardness) were used. A Hunter reflectometer was employed to monitor reflectance of the swatches before and after the wash. Changes in reflectance are reported for each fabric/soil combination along with the 95 percent confidence interval associated with each determination.

EXAMPLE 1

The clay and sebum soil removal performance of a mixed active liquid detergent (LAS/NI/SXS/MEA composition, Formula A in Table I) is shown in Table 2. In this test Pluronic® polyols with differing amounts of EO content were added at 2 percent active to formula A and compared to 2 percent additional Neodol 25-7 (25-7). Results are summarized by soil type.

With sebum soil an additional two percent 25-7 significantly improves detergency (95 percent confidence) on polyester (+1.7 units) and blend (+1.2 units) over the unaided formula. Pluronic® F-68 and F-108, which have a high ethylene oxide content (approximately 80 percent) and are not preferred in the invention, do not significantly enhance sebum soil removal on any fabric. In contrast Pluronic® L-64 and P-123 (both preferred in the invention) substantially improve sebum soil removal over the control on cotton (+2.9 units), polyester (+2.9 units, +1.9 units respectively) and blend (+1.8 units, +1.7 units, respectively).

Moreover, with clay soil only Pluronic® L-64, P-123, and F-68 provide statistically significant improvements (95 percent confidence) on cotton fabric when compared to the unaided formula. Additional 25-7 shows only a slight directional advantage (0.3 Rd unit) which is not statistically significant.

These experiments show that the addition of a low level (~2 percent active) of a preferred EO/PO block copolymer provides the following improvements in detergency performance of formula A:

significant enhancement in soil removal 9–10 Rd units over four fabric/stain combinations and efficacy on both oily and particulate soils.

TABLE 1

FORMULA A: LAS/NI/SXS/MEA COMPOSITION

| COMPONENT | PERCENT BY WEIGHT |
|---|---|
| SODIUM ALKYLBENZENE SULFONATE | 16.0 |
| ETHOXYLATED ALCOHOL (7EO) | 7.0 |
| SODIUM XYLENE SULFONATE | 6.0 |
| MONOETHANOLAMINE | 2.0 |
| BLOCK COPOLYMER OR OTHER ADDITIVE | 2.0 |
| WATER | TO 100 |

TABLE 2

SEBUM AND CLAY SOIL REMOVAL: TERG-O-TOMETER 100° F., 150 ppm

| ADDITIVE (2% ACTIVE) | SEBUM (2 swatches of each fabric type) CHANGE IN REFLECTANCE (DELTA Rd) COTTON (S-405) | POLY (S-767) | BLEND (S-7435) | CLAY/COTTON (S-405) (6 swatches) |
|---|---|---|---|---|
| PLURONIC® L-64 | 18.5 (1.3) | 17.7 (0.5) | 20.5 (0.9) | 19.4 (0.8) |
| PLURONIC® P-123 | 18.5 (1.6) | 16.7 (0.8) | 20.4 (0.6) | 19.6 (0.9) |
| PLURONIC® F-108 | 18.0 (1.7) | 16.0 (1.0) | 19.6 (0.9) | 18.7 (1.1) |
| PLURONIC® F-68 | 17.6 (1.4) | 16.0 (0.6) | 19.5 (1.0) | 20.2 (1.1) |
| NEODOL® 25-7 | 17.9 (1.5) | 16.5 (0.9) | 19.9 (0.5) | 17.9 (0.9) |
| NO ADDITIVE | 15.6 (1.1) | 14.8 (0.6) | 18.7 (0.4) | 17.6 (0.9) |

"Blend" is an abbreviation for 65% Dacron/35% cotton blend.
The number of swatches used are shown above for each fabric/soil combination.
95% confidence intervals appear in parenthesis.

EXAMPLE 2

Studies were conducted with Pluronic® L-64 to determine the effect of block copolymer level on the performance of the mixed active (LAS/NI/SXS/MEA) liquid detergent. As shown in Table 3, the ethoxylated alcohol and Pluronic® L-64 level were varied between 0 and 9 percent active to give a total nonionic content of 9 percent active.

The mixed soil detergency performance of three formulations containing Pluronic® L-64 were compared to compositions based on 9 percent and 7 percent Neodol 25-7 as shown in Table 4. As the results indicate, all three formulations containing Pluronic® L-64 are superior (95 percent confidence) to the 7 percent Neodol 25-7 composition with sebum/cotton, sebum/polyester, sebum/blend and clay/cotton soiled fabrics. Additional 25-7 (9 percent) only improves performance on sebum/cotton and polyester.

The formulation containing 4 percent Pluronic® L-64 and 5 percent 25-7 is also significantly better than 9 percent 25-7 on sebum/polyester and clay/cotton.

These experiments show that higher levels of block copolymer (4–9 percent active) when used in a mixed active detergent also significantly enhance oily and particulate soil removal.

TABLE 3

FORMULA B
LAS/NI/SXS/MEA COMPOSITION

| COMPONENT | PERCENT BY WEIGHT |
|---|---|
| SODIUM ALKYLBENZENE SULFONATE | 16.0 |
| ETHOXYLATED ALCOHOL (7EO) | 0–9.0 |
| PLURONIC® L-64 | 0–9.0 |
| SODIUM XYLENE SULFONATE | 6.0 |
| MONOETHANOLAMINE | 2.0 |
| WATER | TO 100 |

TABLE 4

SEBUM AND CLAY SOIL REMOVAL: TERG-O-TOMETER, 100° F., 150 ppm

| ADDITIVE | SEBUM (2 swatches of each fabric type) CHANGE IN REFLECTANCE (DELTA Rd) COTTON | POLY | BLEND | CLAY COTTON (6 swatches) |
|---|---|---|---|---|
| 9% L-64 | 19.2 (1.2) | 17.4 (0.3) | 18.9 (0.8) | 19.1 (1.1) |
| 6% L-64/3% 25-7 | 19.6 (0.8) | 18.4 (0.3) | 20.0 (0.7) | 19.2 (0.9) |
| 4% L-64/5% 25-7 | 19.3 (1.8) | 18.8 (0.8) | 19.7 (0.5) | 19.6 (0.5) |
| 9% 25-7 | 17.6 (1.1) | 17.5 (0.4) | 19.2 (0.7) | 17.2 (1.2) |
| 7% 25-7 | 14.8 (1.4) | 16.1 (0.4) | 18.3 (0.5) | 16.0 (0.9) |

"Blend" is an abbreviation for 65% Dacron/35% cotton blend.
The number of swatches used are shown for each fabric/soil combination above.
95% confidence intervals are in parenthesis.

EXAMPLE 3

Additional work was carried out with a built liquid detergent containing sodium citrate (formula C, Table 5). The objective of these experiments was to determine whether the block copolymer complements the building action of citrate or fails to enhance detergency performance. In this study a commercial detergent, LIQUID TIDE from Procter & Gamble, was also included for comparison.

Results compiled in Table 6 indicate that the formulation containing 7 percent 25-7 and 2 percent Pluronic® L-64 significantly improves performance (compared to 7 percent 25-7) on sebum/polyester and clay/cotton. Directional advantages are also noted on sebum/blend.

The performance enhancements are more significant when the commercial control (LIQUID TIDE) is considered. The gap between LIQUID TIDE and the 25-7/Pluronic® L-64 formula is large on sebum/polyester (3.1 Rd units) and sebum/blend (3.9 units).

The clay soil removal (cotton) performance of the 25-7 formula is directionally inferior to LIQUID TIDE. But addition of 2 percent Pluronic® L-64 to the LAS/NI/SXS/MEA formula boosts performance to the level of LIQUID TIDE.

TABLE 5

| FORMULA C: CITRATE BUILT LIQUID | |
|---|---|
| COMPONENT | PERCENT BY WEIGHT |
| SODIUM CITRATE | 7.0 |
| SODIUM ALKYLBENZENE SULFONATE | 18.0 |
| ETHOXYLATED ALCOHOL (7EO) | 7.0 or 9.0 as noted |
| PLURONIC ® L-64 | 0.0 or 2.0 as noted |
| SODIUM XYLENE SULFONATE | 6.0 |
| MONOETHANOLAMINE | 2.0 |
| WATER | TO 100 |

TABLE 6

| SEBUM AND CLAY SOIL REMOVAL: TERG-O-TOMETER, 100° F., 150 ppm | | | |
|---|---|---|---|
| ADDITIVE OR FORMULA | COTTON | POLY | BLEND |
| SEBUM (2 swatches of each fabric type) CHANGE IN REFLECTANCE (DELTA Rd) | | | |
| 7% 25-7/2% L-64 | 16.6 (3.1) | 19.6 (0.6) | 22.0 (0.8) |
| 7% 25-7 | 15.0 (1.6) | 17.6 (0.5) | 20.2 (1.5) |
| LIQUID TIDE (2 gm/l) | 15.3 (2.5) | 16.5 (1.0) | 18.1 (1.1) |
| CLAY (2 swatches of each fabric type) CHANGE IN REFLECTANCE (DELTA Rd) | | | |
| 7% 25-7/2% L-64 | 24.8 (1.4) | 36.8 (1.0) | 35.0 (1.0) |
| 7% 25-7 | 21.7 (1.6) | 36.7 (1.1) | 33.4 (1.0) |
| LIQUID TIDE (2 gm/l) | 24.8 (1.8) | 37.1 (0.6) | 35.0 (1.1) |

"Blend" is an abbreviation for 65% Dacron/35% cotton blend.
The number of swatches used are shown for each fabric/soil combination above.
95% confidence intervals appear in parenthesis.

EXAMPLE 4

These advantages were also observed in a light load washing machine assessment. In this study LIQUID TIDE was also evaluated (see Table 7). These experiments show that:

- the 25-7/Pluronic ® L-64 formula (see Table 5, example 3) is significantly better than 25-7 alone on polyester/sebum and clay/cotton and
- the 25-7/Pluronic ® L-64 formula outperforms LIQUID TIDE by 4–6 Rd units on sebum soiled polyester and blend.

It is important to point out that these improvements (4–6 units) can be detected visually.

In summary the experiments disclosed in examples 1–4 indicate that block copolymers can be incorporated into liquid detergents containing mixed actives (anionic and nonionic) to improve both oily and particulate soil removal. These advantages are observed with citrate built and non-built liquids and occur under very different conditions of agitation and soil load (i.e. in both Terg-o-Tometer and washing machine assessments).

TABLE 7

| FORMULA C: CITRATE BUILT LIQUID (TABLE 5) WASHING MACHINE STUDY: SEBUM AND CLAY SOIL REMOVAL WHIRLPOOL IMPERIAL WASHER, 100° F., 150 ppm, light load | | | |
|---|---|---|---|
| ADDITIVE/FORMULA | COTTON | POLY | BLEND |
| SEBUM (six swatches of each fabric type) CHANGE IN REFLECTANCE (DELTA Rd) | | | |
| 7% 25-7/2% L-64 | 12.7 (1.7) | 22.0 (0.5) | 21.3 (0.3) |
| 7% 25-7 | 12.5 (1.6) | 20.0 (0.9) | 20.6 (0.7) |
| LIQUID TIDE | 12.6 (1.6) | 15.9 (0.2) | 17.3 (0.4) |
| CLAY (six swatches of each fabric type) CHANGE IN REFLECTANCE (DELTA Rd) | | | |
| 7% 25-7/2% L-64 | 14.7 (1.5) | 33.0 (1.4) | 31.2 (1.7) |
| 7% 25-7 | 11.0 (1.8) | 32.9 (2.1) | 30.6 (0.4) |

TABLE 7-continued

| FORMULA C: CITRATE BUILT LIQUID (TABLE 5) WASHING MACHINE STUDY: SEBUM AND CLAY SOIL REMOVAL WHIRLPOOL IMPERIAL WASHER. 100° F., 150 ppm, light load | | | |
|---|---|---|---|
| ADDITIVE/FORMULA | COTTON | POLY | BLEND |
| LIQUID TIDE | 14.1 (1.8) | 37.4 (1.1) | 29.3 (0.5) |

"Blend" is an abbreviation for 65% Dacron/35% cotton blend.
The number of swatches used are shown for each fabric/soil combination above.
95% confidence intervals are in parenthesis.

EXAMPLE 5

Experiments were also conducted with a mixed active formulation containing mostly nonionic surfactant. In this case the ethoxylated alcohol and Pluronic L-64 levels were varied between 0 and 16 percent active (the total nonionic content of the formula was 16 percent, see Formula D, Table 8).

Improvements in sebum soil removal are obtained with 25-7/Pluronic ® L-64 blends (10 percent 25-7/6 percent L-64 gives 2.9 Rd unit improvements on polyester/sebum and blend/sebum, see Table 9). No advantages were detected in clay soil removal with this formulation.

This evaluation also shows the importance of using the block copolymer as a co-surfactant. If 16 percent Neodol 25-7 is replaced with Pluronic ® L-64 there is a very large drop in oily soil detergency (25.5 Rd units over the six fabric/soil combinations tested, see Table 9).

These results clearly illustrate the performance downsides of using the block copolymer as the principal surfactant as taught in the prior art.

TABLE 8

| FORMULA D: NI/LAS/TEA COMPOSITION | |
|---|---|
| COMPONENT | PERCENT BY WEIGHT |
| ETHOXYLATED ALCOHOL (7EO) | 0–16.0 as noted |
| PLURONIC ® L-64 | 0–16.0 as noted |
| SODIUM ALKYLBENZENE SULFONATE | 7.0 |
| ETHANOL | 6.0 |
| TRIETHANOLAMINE | 2.7 |
| WATER | TO 100 |

TABLE 9

| SEBUM AND CLAY SOIL REMOVAL: TERG-O-TOMETER, 100° F., 150 ppm | | | |
|---|---|---|---|
| ADDITIVE | COTTON | POLY | BLEND |
| SEBUM (2 swatches of each fabric type) CHANGE IN REFLECTANCE (DELTA Rd) | | | |
| 16% 25-7 | 23.7 (2.2) | 20.3 (0.8) | 21.2 (1.3) |
| 11% 25-7/5% L-64 | 21.3 (3.3) | 23.0 (0.6) | 23.7 (1.4) |
| 10% 25-7/6% L-64 | 21.0 (1.6) | 23.2 (0.9) | 24.1 (0.7) |
| 16% L-64 | 13.4 (4.6) | 12.9 (0.6) | 16.0 (0.7) |
| CLAY (2 swatches of each fabric type) | | | |
| 16% 25-7 | 21.2 (3.6) | 37.9 (1.2) | 28.7 (1.5) |
| 11% 25-7/5% L-64 | 20.2 (1.1) | 38.0 (0.9) | 29.7 (1.1) |
| 10% 25-7/6% L-64 | 20.7 (0.3) | 38.5 (0.5) | 29.4 (0.8) |
| 16% L-64 | 18.8 (3.1) | 38.2 (0.4) | 28.2 (0.7) |

"Blend" is an abbreviation for 65% Dacron/35% cotton blend.
The number of swatches used are shown for each fabric/soil combination above.
95% confidence intervals are in parenthesis.

EXAMPLE 6

The detergency performance of a composition based entirely on nonionic surfactant was also evaluated (see Table 10). Neodol 25-7 and Pluronic® L-64 levels were varied between 0 and 20 percent active. A direct comparison of Neodol® 25-7 and Pluronic ® L-64 performance is given in Table 11. The data show that 20 percent Pluronic® L-64 performs extremely poorly (i.e. 67 Rd units lower than 20 percent Neodol 25-7).

In contrast (see Table 12) when 16 percent 25-7/4 percent Pluronic® L-64 is compared to 20 percent Neodol 25-7 significant improvements in clay soil removal (cotton) are observed.

This example (see Tables 11 and 12) again shows that the use of a block copolymer as a co-surfactant to boost detergency is an advantage that is not found in the prior art. This detergency improvement is unexpected in that it would not be predicted from the performance of the block copolymer alone.

TABLE 10

| FORMULA E: NONIONIC LIQUID | |
|---|---|
| COMPONENT | PERCENT BY WEIGHT |
| ETHOXYLATED ALCOHOL (7EO) | 0–20 as noted |
| PLURONIC ® L-64 | 0–20 as noted |
| TRIETHANOLAMINE | 2.7 |
| WATER | TO 100 |

TABLE 11

| COMPARATIVE EXAMPLES SEBUM AND CLAY SOIL REMOVAL: TERG-O-TOMETER, 100° F., 150 ppm | | | |
|---|---|---|---|
| ADDITIVE | COTTON | POLY | BLEND |
| SEBUM (2 swatches of each fabric type) CHANGE IN REFLECTANCE (DELTA Rd) | | | |
| 20% 25-7 | 23.0 (1.2) | 21.0 (0.9) | 27.1 (1.2) |
| 20% L-64 | 7.1 (1.8) | −0.7 (0.6) | 6.6 (0.4) |
| CLAY (2 swatches of each fabric type) | | | |
| 20% 25-7 | 18.3 (2.4) | 37.7 (1.5) | 32.2 (3.2) |
| 20% L-64 | 16.9 (1.3) | 34.3 (1.6) | 28.2 (2.1) |

"Blend" is an abbreviation for 65% Dacron/35% cotton blend.
The number of swatches used are shown for each fabric/soil combination above. 95% confidence intervals are in parenthesis.

TABLE 12

| SEBUM AND CLAY SOIL REMOVAL: TERG-O-TOMETER, 100° F., 150 ppm | | | | |
|---|---|---|---|---|
| | SEBUM (2 swatches of each fabric type) CHANGE IN REFLECTANCE (DELTA Rd) | | | CLAY/ COTTON (Six swatches) |
| ADDITIVE | COTTON | POLY | BLEND | |
| 16% 25-7/ 4% L-64 | 22.4 (3.7) | 21.0 (0.8) | 24.8 (0.2) | 19.5 (0.7) |
| 20% 25-7 | 24.2 (1.1) | 20.5 (0.3) | 24.6 (1.3) | 17.4 (1.3) |

I claim:

1. A liquid laundry detergent composition having a surfactant component, consisting essentially of:

A. from 7 to 18 percent, by weight, of an anionic surfactant selected from the group consisting of the alkali metal salts of alkyl benzene sulfonate, B. from 3 to 9 percent, by weight, of a nonionic surfactant selected from the group consisting of ethoxylated alcohols containing about 7 ethylene oxide unit per molecule and C. from 2 to 9 percent, by weight, of a nonionic block copolymer as a co-surfactant which is the condensation product of, i) propylene oxide and an organic initiator containing a plurality of reactive hydrogens and, further reacting said condensation product with ii) ethylene oxide in such proportions that the block copolymer contains 30 to 50 percent ethylene oxide and the molecular weight of propylene oxide in the condensation product ranges from about 950 to 4000, wherein said detergent composition exhibits improved particulate soil and oily soil detergency properties on fabric.

2. The detergent composition as claimed in claim 1, wherein the anionic surfactant is selected from the group consisting of the alkali metal salts of an alkylbenzene sulfonate having from 10 to 16 carbon atoms in the alkyl chain.

3. The detergent composition as claimed in claim 2, wherein the anionic surfactant is a sodium salt of a linear alkylbenzene sulfonate.

4. The detergent composition as claimed in claim 1, wherein the ethoxylated alcohol surfactant is the condensation product of an oxyethylated $C_{12}$ to $C_{15}$ aliphatic alcohol.

5. The detergent composition as claimed in claim 1, wherein the nonionic block copolymer contains 40 percent ethylene oxide and the weight of the propylene oxide condensation product is 1750.

6. The detergent composition as claimed in claim 1, wherein the nonionic block copolymer is present in amounts from about 2 weight percent to about 6 weight percent based on the total weight of the system.

7. The detergent composition as claimed in claim 1, wherein said surfactant component consists essentially of an active ingredient of a mixed active heavy duty liquid detergent.

8. The detergent composition as claimed in claim 1, further consists essentially of sodium citrate, in amounts of from about 0.1 to 10.0 weight percent based on the weight of the system, present as a builder.

9. The detergent composition as claimed in claim 1, further consists essentially of a hydrotrope selected from the group consisting of sodium xylene sulfonate and sodium cumene sulfonate.

10. The detergent composition as claimed in claim 3, wherein said sodium salt is sodium linear tridecyl benzene sulfonate or sodium p-n-dodecyl benzene sulfonate.

11. The detergent composition as claimed in claim 1, wherein said anionic surfactant is sodium alkylbenzene sulfonate, said nonionic surfactant is a 7 EO ethoxylated $C_{12}$–$C_{15}$ alcohol and said nonionic block copolymer has 40 percent ethylene oxide and a propylene oxide block having a molecular weight of 1750.

* * * * *